US011713542B2

(12) United States Patent
Yan

(10) Patent No.: US 11,713,542 B2
(45) Date of Patent: Aug. 1, 2023

(54) IRONING PANEL AND IRONING DEVICE

(71) Applicant: NINGBO KAIBO INTELLIGENT IRONING ELECTRIC APPLIANCE MANUFACTURING CO., LTD., Ningbo (CN)

(72) Inventor: Jiebo Yan, Ningbo (CN)

(73) Assignee: NINGBO KAIBO INIELLIGENT IRONING ELECTRIC APPLIANCE MANUFACTURING CO., LTD., Ningbo (CN)

( * ) Notice: Subject to any disclaimer, the term of this patent is extended or adjusted under 35 U.S.C. 154(b) by 25 days.

(21) Appl. No.: 17/391,673

(22) Filed: Aug. 2, 2021

(65) Prior Publication Data

US 2022/0034024 A1 Feb. 3, 2022

(30) Foreign Application Priority Data

Jul. 31, 2020 (CN) ..... 202010756594.4

(51) Int. Cl.
*D06F 75/20* (2006.01)
*D06F 75/24* (2006.01)
*H05B 3/42* (2006.01)

(52) U.S. Cl.
CPC ..... *D06F 75/20* (2013.01); *D06F 75/24* (2013.01); *H05B 3/42* (2013.01)

(58) Field of Classification Search
CPC ..... D06F 75/00; D06F 75/38; H05B 3/42
See application file for complete search history.

(56) References Cited

U.S. PATENT DOCUMENTS 2,160,421 A * 5/1939 Sebo ..... D06F 75/12 68/222
5,613,309 A * 3/1997 Amsel ..... D06F 75/18 38/77.83
6,125,562 A * 10/2000 Dodier ..... D06F 75/38 38/93
9,540,760 B2 * 1/2017 Cai ..... D06F 75/38
2008/0168688 A1 * 7/2008 Hahn ..... D06F 87/00 38/77.8
2014/0013636 A1 * 1/2014 Laudahn ..... D06F 75/14 38/77.83

FOREIGN PATENT DOCUMENTS

CN 204112133 U * 1/2015
GB 2432848 A * 6/2007 ..... D06F 75/08

* cited by examiner

*Primary Examiner* — Ismael Izaguirre
(74) *Attorney, Agent, or Firm* — Muncy, Geissler, Olds & Lowe, P.C.

(57) ABSTRACT

An ironing panel and an ironing device are related to clothes ironing appliances. The temperature distribution of existing ironing panels is non-uniform during ironing. The ironing panel of the invention comprises a panel body provided with a patch having a patch ironing surface, the patch ironing surface and a main ironing surface are continuous to form a complete ironing surface, and a gap is reserved between the patch and the panel body to form a heat homogenizing cavity. When the ironing panel works, an electric heater transfers heat to the panel body, the main ironing surface away from the electric heater is maintained at a low temperature, and heat from the electric heater is indirectly transferred to the patch ironing surface via the main ironing surface and the heat homogenizing cavity rather than being directly transferred to the patch ironing surface.

8 Claims, 3 Drawing Sheets

IRONING PANEL AND IRONING DEVICE

BACKGROUND OF THE INVENTION

1. Technical Field

The invention belongs to clothes ironing appliances, in particular to an ironing panel and an ironing device.

2. Description of Related Art

Steam ironing appliances, such as steam electric irons and steam brushes, convert water into steam, which is then discharged via steam holes in an ironing panel to iron clothes.

Existing ironing panels are supplied with heat by an electric heater. When the electric heater transfers heat to the ironing panel, the temperature distribution on the ironing panel is non-uniform, which is manifested by a high temperature of an area, close to the electric heater, of an ironing surface of the ironing panel and a low temperature of an area, away from the electric heater, of the ironing surface of the ironing panel. As shown in FIG. 6, when the electric heater generates heat and steam is not generated, the temperature distribution on the ironing surface is in the form of U-shaped lines 160, wherein an area with dense U-shaped lines is a high-temperature area, and an area with sparse U-shaped lines is a low-temperature area. As shown in FIG. 7, when the electric heater generates heat and steam is generated, the temperature distribution on the ironing surface is in the form of circular lines 170, wherein an area with dense circular lines is a high-temperature area, and an area with sparse circular lines is a low-temperature area; and in this case, the front end of the ironing surface is at a low temperature because cold water to be converted into steam is delivered thereto. As can be seen from FIG. 6 and FIG. 7, the temperature distribution on the ironing surface is non-uniform regardless of the working state of the ironing panel, so when the high-temperature area is suitable for ironing certain fabric, the ironing effect of the low-temperature area will be weakened; and when the low-temperature area is suitable for ironing certain fabric, the ironing effect of the high-temperature area is too powerful and may damage the fabric, thus reducing the ironing effect of the whole ironing surface.

BRIEF SUMMARY OF THE INVENTION

The technical issue and technical task to be settled by the invention is to provide an ironing panel and an ironing device to overcome the defect of non-uniform temperature distribution of existing ironing panels during ironing.

To fulfill the above objective, the invention provides an ironing panel, comprising a panel body having a main ironing surface for ironing clothes, and an electric heater for supplying heat to the panel body, wherein the panel body is provided with a patch having a patch ironing surface, the patch ironing surface and the main ironing surface are continuous to form a complete ironing surface, and a gap is reserved between the patch and the panel body to form a heat homogenizing cavity.

As a preferred technical solution of the ironing panel, the gap forming the heat homogenizing cavity is 1-5 mm.

As a preferred technical solution of the ironing panel, the patch is located in the middle of the main ironing surface.

As a preferred technical solution of the ironing panel, the electric heater is an electric heating tube buried in the panel body.

As a preferred technical solution of the ironing panel, the electric heater corresponds to the heat homogenizing cavity, and the heat homogenizing cavity is isolated from the patch.

As a preferred technical solution of the ironing panel, a steam channel allowing steam to enter the heat homogenizing cavity is formed in the panel body, and steam holes for discharging the steam are formed in the patch.

To fulfill the above objective, the invention provides an ironing device, comprising the ironing panel.

As a preferred technical solution of the ironing device, a steam generation cavity is formed in a side, backing onto the ironing surface, of the ironing panel, and is communicated with the heat homogenizing cavity via the steam channel.

The ironing device is an electric iron, and the ironing panel is used as an iron base plate.

The ironing device is a steam brush, and the ironing panel is used as a steam discharge panel of the steam brush.

According to the invention, the panel body is provided with the patch having the patch ironing surface, the patch ironing surface and the main ironing surface are kept continuous to form the complete ironing surface, and the gap is reserved between the patch and the panel body to form the heat homogenizing cavity. When the ironing panel works, the electric heater transfers heat to the panel body, and the main ironing surface away from the electric heater is maintained at a low temperature; although the patch ironing surface is close to the electric heater, the electric heater is unable to directly transfer heat to the patch ironing surface due to the existence of the heat homogenizing cavity, and heat from the electric heater is indirectly transferred to the patch ironing surface via the main ironing surface and the heat homogenizing cavity, such that the temperature of the patch ironing surface is kept identical with the temperature of the main ironing surface, which makes the temperature distribution of the whole ironing surface uniform, thus improving the ironing efficiency and the ironing effect.

REFERENCE SIGNS

100, ironing panel;
110, panel body; 111, main ironing surface;
120, electric heater;
130, patch; 131, patch ironing surface; 132, steam hole;

140, gap;
150: closed line;
160, U-shaped line;
170, circular line.
200, electric iron.

DETAILED DESCRIPTION OF THE INVENTION

The invention will be further described below in conjunction with the accompanying drawings in the specification.

Figure 1:
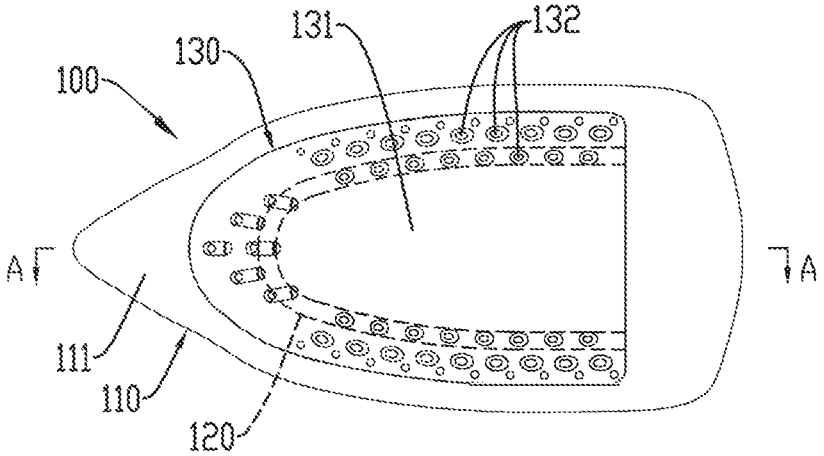
FIG. 1 is a schematic diagram of a complete ironing surface of an ironing panel of the invention.
Figure 2:
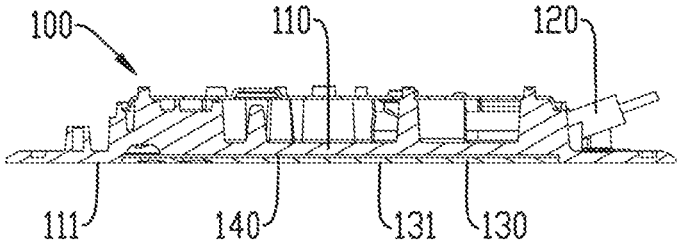
FIG. 2 is a sectional view along A-A in FIG. 1.

As shown in FIG. 1-FIG. 2, an ironing panel 100 comprises a panel body 110 and an electric heater 120 for supplying heat to the panel body, wherein the panel body 110 has a main ironing surface 111 for ironing clothes, and is provided with a patch 130 having a patch ironing surface 131, the patch ironing surface 131 and the main ironing surface 111 are continuous to form a complete ironing surface, the continuity of the patch ironing surface 131 and the main ironing surface 111 means that a continuous ironing surface is formed by the patch ironing surface 131 and the main ironing surface 111, the continuous ironing surface may be a plane or a curved surface, a gap 140 is reserved between the patch 130 and the panel body 110 to form a heat homogenizing cavity, steam channels allowing steam to enter the heat homogenizing cavity are formed in the panel body, and steam holes 132 for discharging steam are formed in the patch. In specific implementation, the steam holes 132 may be formed in the main ironing surface 111, and the steam channels are communicated with the steam holes and are not necessarily communicated with each other.

In specific implementation, the gap 140 forming the heat homogenizing cavity is 1-5 mm. The patch 130 is located in the middle of the main ironing surface 111. The electric heater 120 is an electric heating tube buried in the panel body. The electric heater corresponds to the heat homogenizing cavity, and the heat homogenizing cavity is isolated from the patch.

When the ironing panel works, the electric heater transfers heat to the panel body 110, and the main ironing surface 111 away from the electric heater is maintained at a low temperature; although the patch ironing surface 131 is close to the electric heater, the electric heater is unable to directly transfer heat to the patch ironing surface due to the existence of the heat homogenizing cavity, and heat from the electric heater is indirectly transferred to the patch ironing surface via the main ironing surface and the heat homogenizing cavity, such that the temperature of the patch ironing surface is kept identical with the temperature of the main ironing surface, which makes the temperature distribution of the whole ironing surface uniform, thus improving the ironing efficiency and the ironing effect.

Wherein, the patch is fixed on the panel body preferably by welding or bonding.

Figure 4:
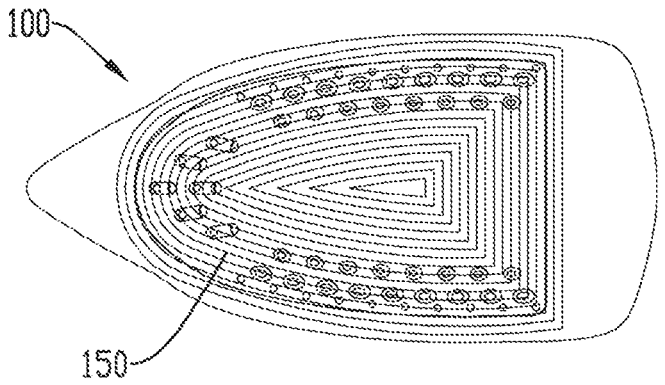
FIG. 4 is a temperature distribution diagram in a case where the ironing panel does not generate steam (dry ironing) according to the invention.
Figure 5:
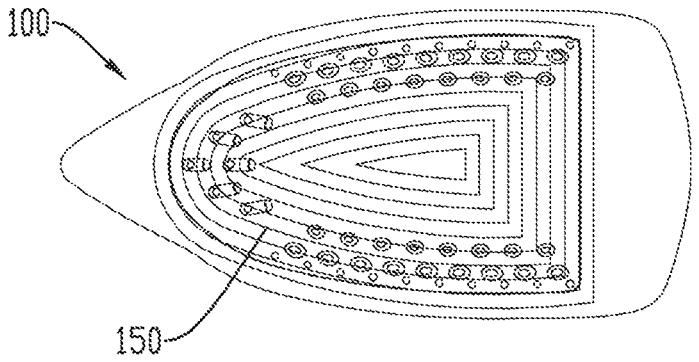
FIG. 5 is a temperature distribution diagram in a case where the ironing panel generates steam (wet ironing) according to the invention.
Figure 6:
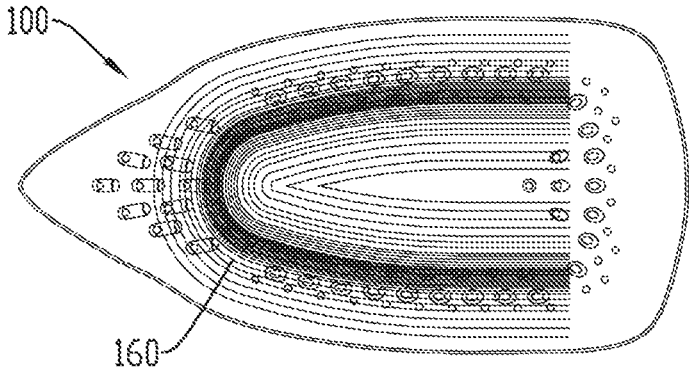
FIG. 6 is a temperature distribution diagram in a case where the ironing panel does not generate steam (dry ironing) according to the prior art.
Figure 7:
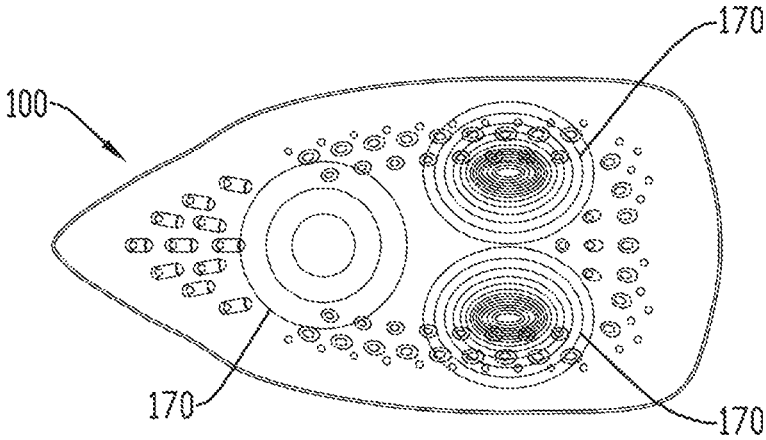
FIG. 7 is a temperature distribution diagram when the ironing panel generates steam (wet ironing) according to the prior art.

As shown in FIG. 4, when the electric heater generates heat and steam is not generated (dry ironing), the temperature distribution on the ironing surface is in the form of closed lines 150 shown in FIG. 4, and the closed lines in FIG. 4 are uniformly distributed, which indicates that the temperature distribution of the whole ironing surface is uniform. As shown in FIG. 5, when the electric heater generates heat and steam is generated (wet drying), the temperature distribution on the ironing surface is in the form of closed lines 150 shown in FIG. 4, and the closed lines in FIG. 5 are distributed uniformly, which indicates that the temperature distribution of the whole ironing surface is uniform. It can be known, by comparing the closed lines in FIG. 4 with the closed lines in FIG. 5, that the density of the closed lines in FIG. 4 is greater than that of the closed lines in FIG. 5, which indicates that the temperature of the ironing surface during dry ironing is higher than the temperature of the ironing surface during wet ironing when the electric heater works under the same condition.

Figure 3:
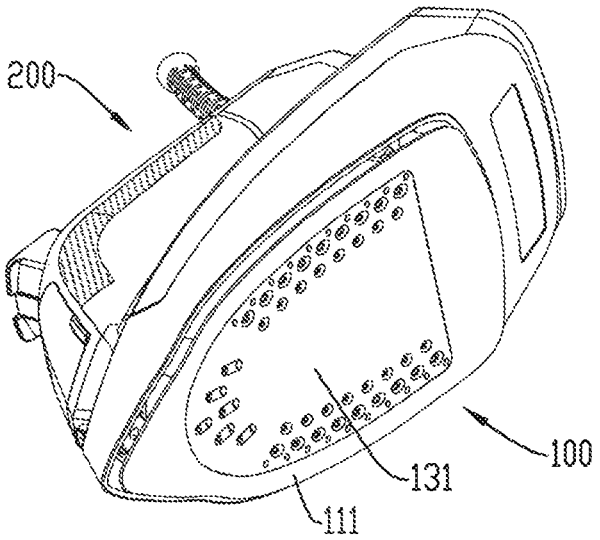
FIG. 3 is a schematic diagram of an electric iron provided with the ironing panel of the invention.

The ironing panel is applied to an ironing device. When applied to an electric iron 200 shown in FIG. 3, the ironing panel is used as an iron base plate. A steam generation cavity is formed in a side, backing onto the ironing surface, of the ironing panel, and is communicated with the heat homogenizing cavity via the steam channels. When steam needs to be generated, water is converted into steam in the steam generation cavity, and then the steam enters the heat homogenizing cavity via the steam channels and is finally discharged via the steam holes to be used for ironing. The steam in the heat homogenizing cavity can also transfer heat to ensure that the temperature distribution of the whole base plate is uniform during wet ironing.

In specific implementation, the ironing device may be a steam brush, and in this case, the ironing panel is used as a steam discharge panel of the steam brush.

What is claimed is:

1. An ironing panel, comprising a panel body having a main ironing surface for ironing clothes, and an electric heater for supplying heat to the panel body, wherein the panel body is provided with a patch having a patch ironing surface, the patch ironing surface and the main ironing surface are continuous to form a complete ironing surface, and a gap is deposited between the patch and the panel body to form a heat homogenizing cavity;

wherein the gap forming the heat homogenizing cavity is 1-5 mm, wherein the patch is located in a middle of the main ironing surface.

2. The ironing panel according to claim 1, wherein the electric heater is an electric heating tube buried in the panel body.

3. The ironing panel according to claim 2, wherein the electric heater corresponds to the heat homogenizing cavity, and the heat homogenizing cavity is isolated from the patch.

4. The ironing panel according to claim 1, wherein a steam channel allowing steam to enter the heat homogenizing cavity is formed in the panel body, and steam holes for discharging the steam are formed in the patch.

5. An ironing device, comprising the ironing panel according to claim 1.

6. The ironing device according to claim 5, wherein a steam generation cavity is formed in a side, backing onto the ironing surface, of the ironing panel, and is communicated with the heat homogenizing cavity via the steam channel.

7. The ironing device according to claim 5, wherein the ironing device is an electric iron, and the ironing panel is used as an iron base plate.

8. The ironing device according to claim 5, wherein the ironing device is a steam brush, and the ironing panel is used as a steam discharge panel of the steam brush.

* * * * *